US006112433A

United States Patent [19]

Greiner

[11] Patent Number: 6,112,433

[45] Date of Patent: Sep. 5, 2000

[54] CERAMIC GRIPPING ELEMENT FOR SPORTS SHOES

[76] Inventor: Peter Greiner, Damooserweg 15, D-88267 Vogt, Germany

[21] Appl. No.: 09/340,893

[22] Filed: Jun. 28, 1999

Related U.S. Application Data

[63] Continuation of application No. PCT/DE98/03160, Oct. 27, 1998.

[30] Foreign Application Priority Data

Oct. 30, 1997 [DE] Germany ..... 297 19 312 U

[51] Int. Cl.[7] ..... A43C 13/04; A43C 15/00; A43B 5/00

[52] U.S. Cl. ..... 36/67 R; 36/134; 36/67 D

[58] Field of Search ..... 36/67 R, 67 A, 36/67 D, 59 R, 134, 59 A

[56] References Cited

U.S. PATENT DOCUMENTS

| | | | |
|---|---|---|---|
| 4,712,318 | 12/1987 | Greiner et al. | 36/67 R |
| 4,833,796 | 5/1989 | Flemming | 36/67 D |
| 5,572,807 | 11/1996 | Kelly et al. | 36/67 R |

FOREIGN PATENT DOCUMENTS

| | | | |
|---|---|---|---|
| 1 210 362 A2 | 2/1987 | European Pat. Off. . | |
| 280 108 A2 | 8/1988 | European Pat. Off. . | |
| 0 501 853 A1 | 9/1992 | European Pat. Off. . | |
| 2 532 825 A1 | 3/1984 | France . | |
| 2539595 | 7/1984 | France | 36/67 R |
| 85 26 101 U | 2/1986 | Germany . | |
| 36 03 127 C1 | 6/1987 | Germany . | |

*Primary Examiner*—M. D. Patterson
*Attorney, Agent, or Firm*—Hoffman & Baron, LLP

[57] ABSTRACT

A gripping element for sports shoes comprising a gripping element body of plastic material and a ceramic insert (2) which forms the tread surface of the gripping element and which is embedded in the gripping element body and which is embraced within the gripping element body over a part of its length by a metal sleeve (3) which is also embedded in the gripping element body. In that arrangement a plastic material layer (14) is formed between the peripheral surface of the ceramic insert and the inside surface of the metal sleeve. In order to make the plastic material layer as uniform as possible in its wall thickness. at least the part of the peripheral surface of the ceramic insert (2), that is embraced by the metal sleeve, is smooth and narrows towards the tread surface (FIG. 1).

21 Claims, 3 Drawing Sheets

CERAMIC GRIPPING ELEMENT FOR SPORTS SHOES

This is a continuation of International Application Ser. No. PCT/DE98/03160 having an International filing date of Oct. 27, 1998.

DESCRIPTION

The invention concerns a gripping element for sports shoes, comprising a gripping element body of plastic material and a ceramic insert which forms the tread surface of the gripping element and which is embedded into the gripping element body and which is embraced within the gripping element body over a part of its length by a metal sleeve which is also embedded into the gripping element body. In that arrangement a plastic layer is provided between the peripheral surface of the ceramic insert and the inside surface of the metal sleeve.

There are already numerous proposals for using ceramic inserts for example of aluminum oxide, silicon carbide. tungsten carbide and so forth on gripping elements of sports shoes, in order substantially to prolong the service life of the gripping elements by virtue of making use of the very high resistance to wear of the ceramic material, and also to avoid the occurrence of wear-induced sharp edges and notches and jagged configurations on the gripping elements, which give rise to a risk of injury. Hitherto however it has been found difficult on the one hand to connect the ceramic insert to the gripping element body so firmly that the connection can reliably withstand the forces which act thereon in use of the sports shoe, and on the other hand in that respect to keep the level of manufacturing expenditure so low that a ceramic gripping element is actually worthwhile, in comparison with the gripping elements of conventional configuration.

A known ceramic gripping element of the kind set forth in the opening part of this specification (EP-A-231 797) already affords a relatively advantageous ratio in respect of stability/production cost. In that gripping element, at its peripheral surface which is embraced by the metal sleeve the ceramic insert has recesses and/or projections, preferably annular ribs and annular grooves, which are filled and encased respectively by the plastic layer within the metal sleeve. Besides providing for securing the ceramic insert in position in positively locking relationship, those annular ribs/annular grooves serve in particular to provide that, by means of the thicker portions of the plastic layer between the peripheral surface of the ceramic insert and the inside surface of the metal sleeve, the forces acting on the ceramic insert in use of the gripping element are more uniformly transmitted to the metal sleeve and by way thereof to the gripping element body. This known gripping element however also does not in every case eliminate the risk of local over-loading of the connection between the ceramic insert and the gripping element body in the region of the metal sleeve.

Therefore the object of the present invention is to design a gripping element of the kind set forth in the opening part of this specification, in such a way that the stability and strength thereof is increased, while being of a simple and therefore inexpensive structure.

In accordance with the invention that object is attained in that at least the part of the peripheral surface of the ceramic insert, which is embraced by the metal sleeve, is smooth and narrows towards the tread surface.

As in accordance with the invention the ceramic insert does not have any recesses or projections on its peripheral surface but that peripheral surface is very substantially smooth and is at least slightly narrowed or tapered in the direction towards the tread surface, the production procedure involves the formation of a plastic layer between that peripheral surface and the inside surface of the metal sleeve, wherein the thickness of the plastic layer very uniformly decreases in a manner corresponding to the taper of the ceramic insert, to the end face that is remote from the tread surface. It has been found that, in the event of a lateral loading being applied to the ceramic insert, the bearing pressure produced thereby in the critical region of the edge of the metal sleeve is transmitted in such a way that at that point, even in a situation involving a heavy loading, no tendency on the part of the ceramic insert to come loose due to local destruction of the plastic material is to be observed. As furthermore just a very slight narrowing or taper configuration is already sufficient for the ceramic insert to be held in the gripping element body in positively locking relationship therewith, in particular within the metal sleeve. so that the configuration of the ceramic insert is close to a cylinder, an advantageous stress field or pattern occurs in the ceramic insert itself under the loading, so that its tendency to fracture is very slight. In accordance with a preferred embodiment the taper angle does not exceed a value of 6°. Finally the expenditure involved in production of the ceramic insert according to the invention, particularly if it is desirably smooth continuously as far as its tread surface and is of a tapered configuration, is markedly lower than the expenditure required for producing the ceramic insert referred to in the opening part of this specification, with recesses and projections at its peripheral surface. Thus, by virtue of its simple shape, the ceramic insert can already be available in an accurate size immediately after the ceramicfiring operation. Even if a grinding operation is considered to be advantageous to achieve the smooth peripheral surface, that can easily be effected by virtue of the shallow taper.

The dimensions of the metal sleeve and the ceramic insert are matched to each other in such a way that the ceramic insert can be fitted into the metal sleeve as far as a bottom end portion thereof. As a result of the taper of the ceramic insert and the desirably cylindrical inside surface of the metal sleeve, an annular gap is produced in any case in the region of the edge of the sleeve, and in manufacture of the gripping element the plastic material which is capable of flow at that time can pass through the annular gap into the interior of the sleeve and the above-mentioned plastic layer can be formed therein. It will be appreciated that the width of the annular gap depends on the clearance which exists between the inside surface of the metal sleeve and the end of the ceramic insert, that is remote from the tread surface. That clearance should be only a few tenths of a millimeter and is advantageously so small that the inside surface of the metal sleeve almost bears against the end of the ceramic insert, that is remote from the tread surface. In order to ensure that in the production procedure the plastic material of the gripping element body in this case also satisfactorily embeds the ceramic insert, it is desirable for through openings to be provided in the wall of the metal sleeve, being uniformly distributed over the periphery thereof. The plastic material can penetrate through the through openings into the interior of the sleeve and the plastic layer can also be satisfactorily formed even in the region in which the thickness thereof is slight.

An advantageous development of the invention provides that, in its end face that is remote from the tread surface, the ceramic insert has a recess or depression which extends through the peripheral surface. In the production procedure, by virtue of the communication of the depression with the peripheral surface, the depression is filled with plastic material which in that manner positively lockingly connects the ceramic insert at the end face thereof to the gripping element body. The depression in the simplest case can be a straight groove which extends transversely over the end face and the two ends of which pass through the peripheral surface of the ceramic insert. It is however also possible for the depression to be in the shape of a cross or a star. wherein the arms of the cross or star extend through the peripheral surface of the ceramic insert. The corresponding connection provides that the ceramic insert is also positively lockingly connected to the gripping element body, in relation to torque forces acting about its longitudinal axis. In that way the ceramic insert can also withstand the attempts, that frequently occur, to release the gripping element from the sole of a sports shoe by using a pair of pliers, when the wrench surfaces on the gripping element body are already worn.

The gripping element according to the invention can either be releasably connected to a sports shoe sole in the usual manner or it can be formed on the sole directly and then in material unity in respect of the gripping element body and the sole. In order to carry the vertically directed loading which in use occurs due to the weight of the sportsperson and to transmit such loading into the sole of the sports shoe. it is advantageous if the metal sleeve supports the ceramic insert at its end face that is remote from the tread surface, and for that purpose has a bottom end portion. In the releasable embodiment of the gripping element which has a metal shank projecting out of the gripping element body for releasable fixing of the gripping element, the metal sleeve is desirably turned over or crimped around a flange-like enlargement portion of the metal shank and welded thereto. In that case the enlargement portion forms the bottom end portion of the metal sleeve. When the gripping element is in one piece with the sole the metal sleeve engages with its upper edge around a disk forming the bottom end portion and is connected thereto, desirably by pressing or welding.

The ceramic insert and in particular the part thereof which is embraced by the metal sleeve is normally circular in its cross-section, with the metal sleeve being suitably adapted in regard to its shape. It is however also possible in principle to envisage a cross-sectional configuration which differs from a circular shape, for example an oval or elongate cross-section, if a smooth peripheral surface is guaranteed.

Further advantages and features of the invention will be apparent from the following description of embodiments with reference to the accompanying drawings and from further appendant claims. In the drawings:

Figure 1:
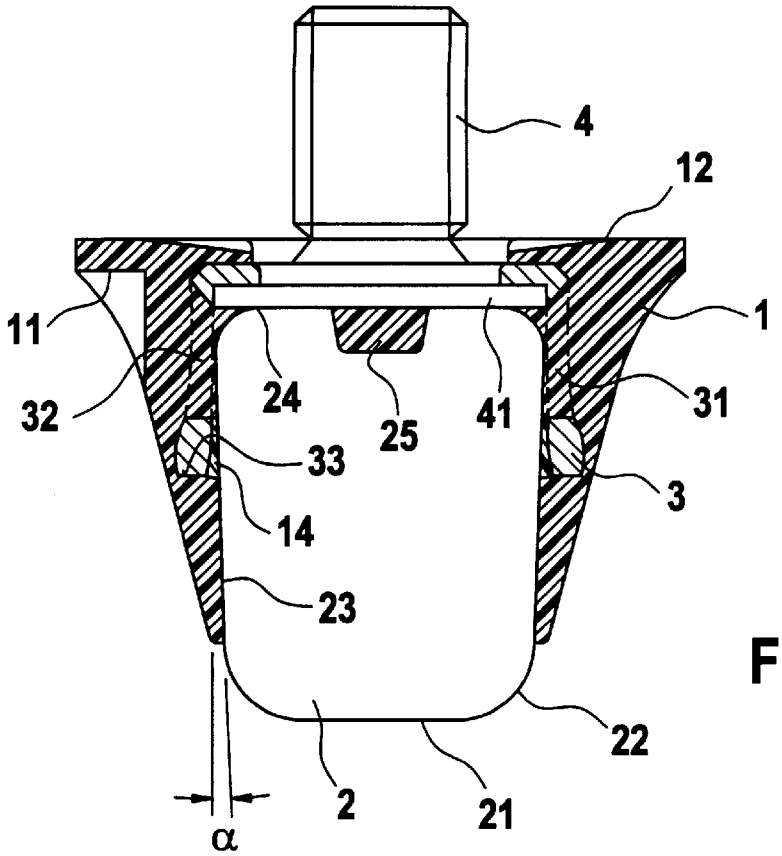
FIG. 1 is a view in longitudinal section through a stud-shaped gripping element.
Figure 2:
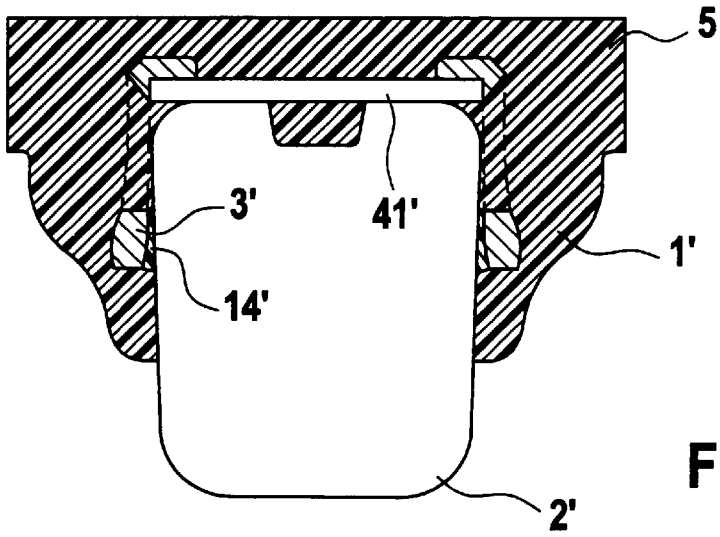
FIG. 2 is a similar longitudinal section through a gripping element which is non-releasably connected to a sole in the manner of a dog.
Figure 3:
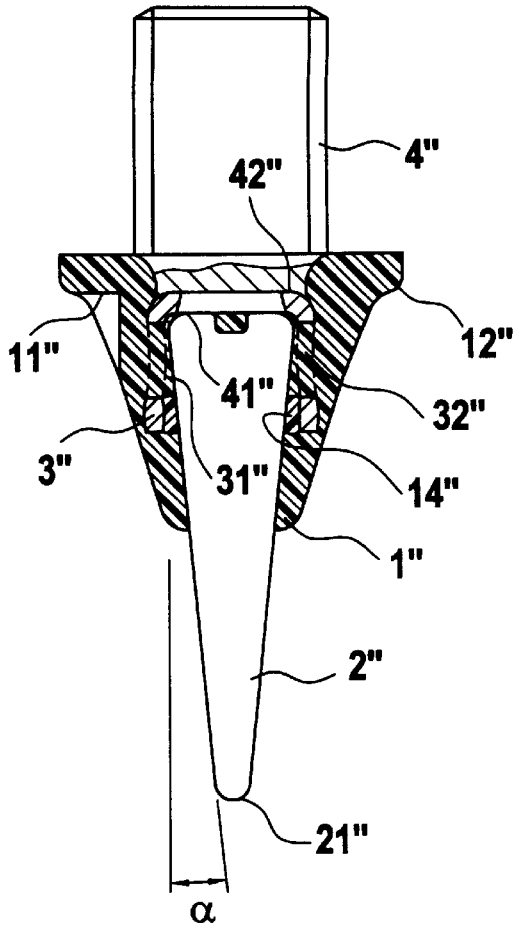
FIG. 3 shows a further similar longitudinal section through a releasable gripping element in the form of a spike, for example for a golf shoe.

The gripping elements shown on an enlarged scale in FIGS. 1 through 3 are without exception rotationally symmetrical in their essential parts and in their configuration so that there is no need to show an end view. However, as already discussed above, the rotationally symmetrical shape is not a necessary prerequisite for the invention but can be modified to the benefit of for example an oval or elongate cross-sectional configuration.

The stud which is illustrated in FIG. 1, for example for a football boot, substantially comprises a gripping element body 1, a ceramic insert 2 and a metal sleeve 3 which at its top end is continued in the form of a metal shank 4 provided with a screwthread.

The gripping element body 1 comprises a plastic material which is set to be relatively hard, for example polyamide or polyurethane, which is capable of flow in the production procedure and which can be processed for example using an injection molding process. The configuration of the gripping element body 1 is of a nature as is known from conventional gripping elements, in particular studs, and therefore does not need to be described in greater detail herein. That applies in particular in regard to the fact that this configuration at the outside of the gripping element body 1 is also not critical, but can be of any conical or cylindrical nature. In addition, engagement surfaces 11 are provided in known manner for a tool or wrench for turning the gripping element, and the support surface 12 which comes to bear against the ground-engaging side of the outsole (not shown) can bear a profiling configuration which prevents or impedes accidental rotation of the gripping element in the condition of being fixed to the sole.

The ceramic insert 2 is an impact-resistant ceramic part and comprises for example predominantly (96%) aluminum oxide ($Al_2O_3$), silicon carbide (SiC), silicon nitride, zirconium oxide, steatite or other oxidic or non-oxidic high-performance ceramics. It has a tread surface 21 which can be flat or of a slightly lens-shaped curved configuration and which goes into the peripheral surface 23 with an acutely rounded transitional portion 22. The peripheral surface 23 is slightly conical, that is to say it tapers towards the tread surface 21; the taper angle $\alpha$ (or half the cone angle) in the illustrated embodiment is about 1.5° and desirably does not exceed 2°. The upper end face 24 of the ceramic insert 2, which is remote from the tread surface 21 and the edge of which is also rounded, has a straight groove 25 of a substantially rectangular cross-section, the groove 25 extending transversely over the end face 24 and being open towards both sides to the peripheral surface 23. In the illustrated embodiment the diameter of the ceramic insert 2 at its upper end is about 10 mm, its length is about 11 mm and the depth of the groove 25 is about 1.5 mm.

The metal sleeve 3 comprises steel and engages over the upper part of the ceramic insert 2 over about 40% of the length of the ceramic insert. At the lower end of the metal shank 4 it is shaped to form a flange-like enlargement portion 41. over the edge of which the upper end of the metal sleeve 2 is turned and welded thereto. That arrangement means that the enlargement portion 41 forms a flat bottom end portion, against which the flat end face 24 of the ceramic insert 2 is directly supported. The inside surface 31 of the metal sleeve 3 is approximately cylindrical and its diameter is so selected that the ceramic insert 2 bears with its upper end, in the region of the transition to its peripheral surface 23, almost or entirely against the inside surface 31. In addition, the metal sleeve 3 has six circular through openings 32 which are uniformly distributed around its periphery and which are so large that they permit the plastic material to have access to the space defined by the rounded configuration of the end face 24, and thus to the ends of the groove 25. The lower end portion 33 of the metal sleeve 3 is stepped by an increased wall thickness and strengthened thereby.

As can be seen from FIG. 1 both the ceramic insert 2 over the major part of its length and also the metal sleeve 3 are embedded in the plastic material of the gripping element body 1 and are fixed thereby in positively locking relationship. In that arrangement the plastic material of the gripping element body extends into the space which exists between the inside wall surface of the metal sleeve 3 and the peripheral surface 23 of the ceramic insert, and forms there a plastic layer 14 by way of which the ceramic insert 2 is supported against the metal sleeve 3 when the gripping element is subjected to a loading in the radial direction, that is to say transversely with respect to its longitudinal axis. In a manner corresponding to the shape of that space, the thickness of the plastic layer 14 uniformly decreases in a direction towards the end face 24, apart from the connection to the gripping element body 1 by way of the through openings 32. and is in any case substantially constant in the peripheral direction in the thickened region 33 of the metal sleeve 3. The edges of the through openings 32 can be rounded in a manner not shown in the drawing. in order to minimise shearing effects on the plastic material connections to the gripping element body 1, which extend through the through openings 32.

The fact that the upper end face 24 of the ceramic insert 2 bears directly against the bottom end portion 41 of the metal sleeve 3 means that. at that location, no plastic material layer is formed outside the groove 25 in the procedure for producing the gripping element. so that that location involves ceramic-metal contact and consequently vertical loadings are transmitted directly to the metal sleeve 3 or the screwthreaded shank 4. Within the limits of the inevitable manufacturing tolerances both in regard to the ceramic insert 2 and also in regard to the metal sleeve 3 however it can happen that the end face 24 does not bear uniformly against the bottom end portion 41. That makes it possible for plastic material also to be disposed outside the groove 25 between the end face 24 and the bottom end portion 41. That is desirable however because, as a result, the plastic material fills up the 'dead space' which is correspondingly formed, and thereby renders the transmission of force uniform. In addition. shocks and impacts which occur are damped. in accordance with the elasticity of the plastic material. If that effect is to be emphasised the end face 24 can also be of a convex shape in a lens-like configuration.

The gripping element in dog shape, which is shown in FIG. 2. has a gripping element body 1' which comprises the same plastic material as the outsole 5 of which only part is shown, and is in one piece therewith. That plastic material differs from that which constitutes the gripping element body shown in FIG. 1. in order by virtue of suitable softness and flexibility to satisfy the requirements made in regard to the function of an outsole. The ceramic insert 2' is identical to the ceramic insert 2 shown in FIG. 1 and therefore does not need to be described in greater detail. This also applies in regard to the part, which engages over the ceramic insert 2, of the metal sleeve 3' which differs from the embodiment described with reference to FIG. 1 in that its bottom end portion 41' is formed by a flat disk which is welded or pressed to the flanged-over upper edge of the metal sleeve 3'.

The embodiment of FIG. 3 substantially corresponds in its basic structure to that shown in FIG. 1. It has a gripping element body 1" which comprises a plastic material that is set to be comparatively hard, for example polyamide, and it is of a conical shape. It has engagement surfaces 11" for actuation by a suitable rotary tool or wrench and it is enlarged to form an edge 12" at its upper end which is intended to bear against the outsole (not shown).

In this embodiment, because of its intended purpose as a golf shoe spike, the ceramic insert 2" is relatively slender, that is to say with a diameter of about 3 mm at the upper end and 0.6 mm at the tread surface 21", it is about 12.5 mm in length. The taper angle a (or half the cone angle) at which the ceramic insert 2" conically tapers is here about 6°. In this embodiment, as a result of the small diameter and the rounded configuration which can be seen in FIG. 3, the tread surface 21" is comparatively small and acts as a pointed tip.

At its upper end the metal sleeve 3" is connected to a metal shank 4" by being pressed into a groove 42" formed in the lower end face of the metal shank. Its bottom end portion is therefore formed directly by the end face 41" of the metal shank 4". In the usual manner the metal shank 4" has a male screwthread so that it can be joined to a suitable screwthreaded insert in the sole of a golf shoe. In its wall, the metal sleeve 3" has four peripherally uniformly distributed through openings 32" which extend upwardly to such an extent that the plastic material which enters in the production procedure can flow around the upper end of the ceramic insert 2" and pass into a groove (not shown) provided at that location in the end face of the ceramic insert.

In conformity with the above-described embodiments, the metal sleeve 3" has a cylindrical inside surface 31" so that, as a result of the greater taper of the ceramic insert 2" a plastic layer 14" is formed in the production procedure between the inside surface 31" and the peripheral surface of the ceramic insert, with the thickness of the plastic layer 14" decreasing more quickly in an upward direction. In the region of the lower edge of the metal sleeve 3" therefore the ceramic insert 2" is supported against the metal sleeve 3" by way of a comparatively thick annular part of the plastic layer 14". As a result of the slender nature of the ceramic insert 2" and the length thereof, relatively high lateral loadings occur in that region, but those loadings are better distributed and transmitted to the metal sleeve 3" by the thicker plastic layer 14".

Figure 5:
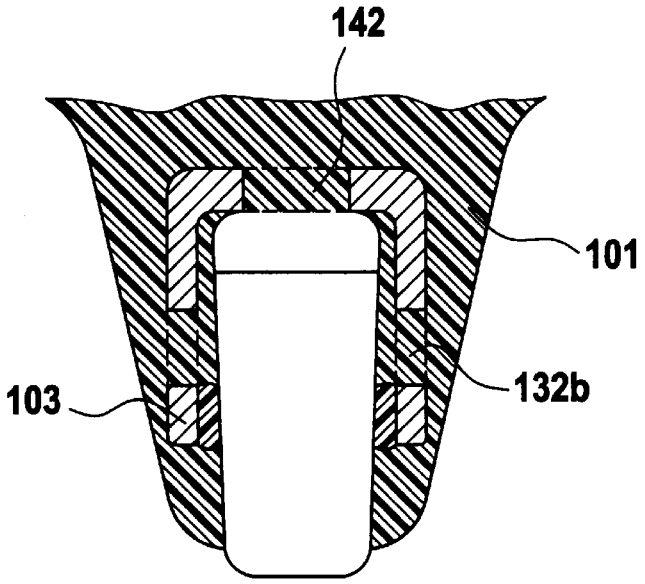
FIG. 5 is a view in section taken along line V—V in FIG. 4.
Figure 4:
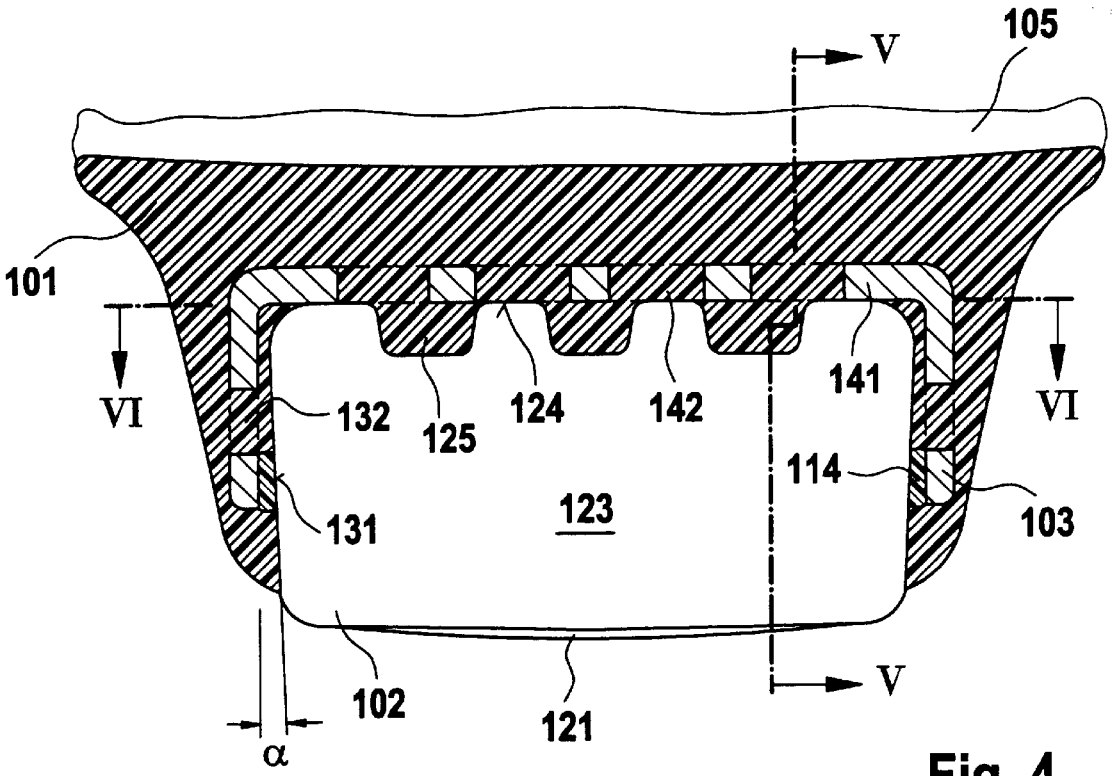
FIG. 4 shows a further similar longitudinal section through a gripping element of elongate configuration which is non-releasably connected to a sole in the manner of a dog.
Figure 6:
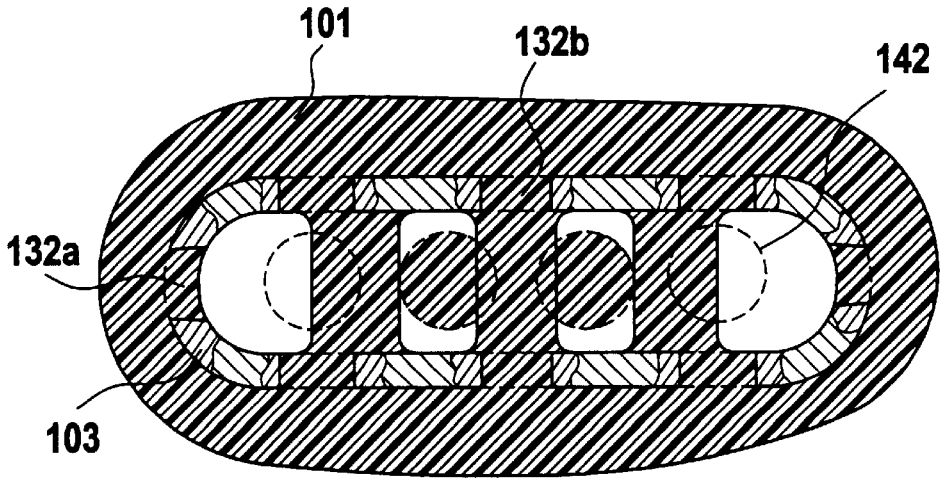
FIG. 6 is a view in section taken along line VI—VI in FIG. 4.

The gripping element shown in FIGS. 4 through 6 has a gripping element body 101 which, as in the embodiment shown in FIG. 2, comprises the same plastic material as the outsole 5 of which only part is shown, and is in one piece therewith. The ceramic insert 102 which is enclosed by the gripping element body 101 however is of an elongate cross-section with mutually parallel longitudinal sides which are connected together at their ends by circular arcs. The ceramic insert 102 tapers downwardly at the end and side faces at a taper angle a which here is about 2°. The tread surface 121 is slightly crowned or cambered while the flat upper end face 124 has three grooves 125 which extend transversely with respect to the longitudinal axis of the ceramic insert 102 and which pass through the side surfaces. At their transitions to the side surfaces 123 the grooves 125 are rounded, as can be seen from FIG. 6. In the illustrated embodiment the length of the ceramic insert 102 at its upper end is about 17 mm, its width is about 4 mm and its height (which corresponds to the length of the embodiments shown in FIGS. 1 through 3) is about 8.5 mm.

The ceramic insert 102 is embraced over about two-thirds of its height by a metal sleeve 103 forming an internal space which is shaped to correspond to the cross-section of the ceramic insert. The inside surface 131 of the metal sleeve 103 is formed by generatrices which extend in mutually parallel relationship in the top-bottom direction. The metal sleeve 103 is formed in one piece from steel, for example by extrusion or deep drawing, and has a bottom end portion 141 which incorporates four circular through openings 142 uniformly distributed in the longitudinal direction of the bottom end portion 141. In addition, at its mutually opposite end faces which are in the form of circular cylinders, the metal sleeve 103 has a respective circular through opening 132*a* and at the same height in the mutually parallel side surfaces three uniformly distributed, circular through openings 132*b*. The through openings 142 in the bottom end portion 141 are so arranged that they at least partially correspond with the grooves 125 of the ceramic insert 102 so that in the casting operation plastic material can penetrate into the grooves through the openings 142.

With its upper end face 124 the ceramic insert 102 bears against the bottom end portion outside the grooves 125 or the openings 142 respectively and is also embedded in the plastic material of the gripping element body 101. Here also the plastic material of the gripping element body 101 is extended into the interior of the metal sleeve 103 so that a plastic layer 114 is provided between the inside wall surface of the metal sleeve and the side or peripheral surface 123 of the ceramic insert 102. In a manner corresponding to the configuration of the space inside the sleeve, the thickness of the plastic layer 114 uniformly decreases in a direction towards the end face 124, apart from the connection to the gripping element body 101 by way of the openings 132*a*, 132*b*, and is in any case substantially constant in the peripheral direction in the lower edge region of the metal sleeve 103.

It is possible to deviate from the above-described embodiments in various ways without thereby departing from the scope of the invention: as already mentioned hereinbefore through openings in the metal sleeve are not absolutely necessary because the tapered configuration of the ceramic insert means in any event that there is provided at the lower edge of the metal sleeve an annular gap through which plastic material can pass to form the desired plastic layer if the inside surface of the metal sleeve is cylindrical. The latter however is also not absolutely necessary, in other words the metal sleeve can in turn be of a tapering configuration in an upward or downward direction. In this case, it can be provided by suitable dimensioning and/or by means of through openings that the plastic material can satisfactorily embed the ceramic insert, in the production procedure.

Although the invention refers exclusively to the use of inserts comprising ceramic because that has the property of not producing sharp edges when wear occurs, the use of inserts comprising hard metal or alloy or carbide metal is considered here to be equivalent.

The notion of smoothness of the peripheral surface of the ceramic insert, which is employed in the present description, does not relate primarily to a given roughness of the ceramic surface, but to the fact that this peripheral surface does not have any projections or recesses which noticeably determine its geometrical configuration. On that condition however a certain roughness of the ceramic surface can promote bonding of the plastic material to the peripheral surface of the ceramic insert so that preferably the ceramic insert is inserted in the fired condition without subsequent machining of its peripheral surface.

What is claimed is:

1. A gripper element for sports shoes, comprising:

a gripping element body of plastic material;

a ceramic insert which forms a tread surface of the gripping element and which is embedded into the gripping element body;

a metal sleeve embedded into the gripping element body, the ceramic insert being embraced within the gripping element body over a part of its length by the metal sleeve, the ceramic insert including a continuously tapering surface over the length of the ceramic insert surrounded by the metal sleeve, wherein a plastic layer is provided between a peripheral surface of the ceramic insert and an inside between a peripheral surface of the ceramic insert and an inside surface of the metal sleeve, wherein at least the part of the peripheral surface of the ceramic insert that is embraced by the metal sleeve is smooth and narrows towards the tread surface.

2. A gripping element as set forth in claim 1 characterised in that the ceramic insert is smooth and narrows continuously to its tread surface.

3. A gripping element as set forth in claim 1 characterized in that the ceramic insert is circular in cross-section and conically tapered, wherein the taper angle ($\alpha$) is a maximum of 6°.

4. A gripping element as set forth in claim 1 characterized in that the inside surface of the metal sleeve is cylindrical.

5. A gripping element as set forth in claim 1 characterized in that the metal sleeve is thickened at its edge that is towards the tread surface.

6. A gripping element as set forth in claim 5 characterized in that the metal sleeve has a wall ending in a rim, the rim having a thickness greater than the wall.

7. A gripping element as set forth in claim 1 characterized in that the metal sleeve has through openings in its wall.

8. A gripping element as set forth in claim 7 characterised in that the through openings are uniformly distributed around the periphery of the metal sleeve.

9. A gripping element as set forth in one of claim 1 characterized in that the inside surface of the metal sleeve bears against the end of the ceramic insert, that is remote from the tread surface.

10. A gripping element as set forth in claim 1 characterized in that the ceramic insert included an end face that is remote from the tread surface, the ceramic insert end face having at least one depression which passes through the peripheral surface of the ceramic insert.

11. A gripping element as set forth in claim 10 characterised in that the depression is a straight groove which passes with both ends through the peripheral surface of the ceramic insert.

12. A gripping element as set forth in claim 10 characterized in that the depression includes at least two intersecting linear elements that pass through the peripheral surface of the ceramic insert.

13. A gripping element as set forth in claim 10 characterized in that the end face of the ceramic insert, that is remote from the tread surface, bears against a bottom end portion of the metal sleeve.

14. A gripping element as set forth in claim 13 characterised in that the end face is of a slightly convexly curved configuration.

15. A gripping element as set forth in claim 1 with a metal shank (4, 4") which projects out of the gripping element body for releasibly fixing the gripping element to a sole, characterized in that the metal sleeve is fixed to the metal shank.

16. A gripping element as set forth in claim 15 characterized in that the metal sleeve is secured to an enlargement portion of the metal shank and the enlargement portion forms the bottom end portion of the metal sleeve.

17. A gripping element as set forth in claim 1 which is formed in one piece with a sole and is unitary in terms of material in relation to the gripping element body, characterized in that the metal sleeve is secured to an edge of a disk which forms the bottom end portion of the metal sleeve.

18. A gripping element as set forth in claim 1 which is formed in one piece with a sole and is unitary in terms of material in relation to the gripping element body, characterized in that the bottom end portion of the metal sleeve has at least one through opening.

19. A gripper element for sports shoes comprising:

a gripping element body of plastic material;

a ceramic insert embedded into the gripping element body forming the tread surface of the gripping clement, the ceramic insert being substantially circular in cross-section and conically tapered having a maximum taper angle of 6 degrees;

a metal sleeve embedded into the gripping element body, the ceramic insert being embraced within the gripping element body over a part of its length by the metal sleeve, wherein at least the part of the peripheral surface of the ceramic insert that is embraced by the metal sleeve is smooth and narrows towards the tread surface, insert; and a plastic layer provided between a peripheral surface of the ceramic insert and an inside surface of the metal sleeve.

20. A gripping device as set forth in claim 19, wherein the taper angle is a maximum of 2 degrees.

21. A gripper element for sports shoes comprising:

a gripping element body of plastic material;

a ceramic insert embedded into the gripping body forming the tread surface of the gripping element, the ceramic insert having an end face that is remote from the tread surface, the end face including at least one depression passing through a peripheral surface of the ceramic insert for receiving plastic material, such that rotation of the ceramic insert relative to the gripping body is restricted;

a metal sleeve embedded into the gripping element body, the ceramic insert being embraced within the gripping element body over a part of its length by the metal sleeve, wherein at least the part of a peripheral surface of the ceramic insert that is embraced by the metal sleeve is smooth and narrows towards the tread surface; and a plastic layer provided between a peripheral surface of the ceramic insert and an inside surface of the metal sleeve.

* * * * *

UNITED STATES PATENT AND TRADEMARK OFFICE

CERTIFICATE OF CORRECTION

PATENT NO. : 6,112,433

DATED : September 5, 2000

INVENTOR(S) : Peter Greiner

It is certified that error appears in the above-identified patent and that said Letters Patent are hereby corrected as shown below:

IN THE ABSTRACT:

| | | |
|---|---|---|
| **Line 11,** | **now reads:** | **"thickness. at least"** |
| | **should read:** | **--thickness, at least--.** |
| **Column 1, lines 20-21,** | **now reads:** | **"silicon carbide. tungsten"** |
| | **should read:** | **--silicon carbide, tugsten--;** |
| **Column 2, lines 19-20,** | **now reads:** | **"sleeve. so that"** |
| | **should read:** | **--sleeve, so that--;** |
| **Column 3, line 9,** | **now reads:** | **"a star. wherein the"** |
| | **should read:** | **--a star, wherein the--;** |
| **Column 3, line 25,** | **now reads:** | **"sports shoe. it is"** |
| | **should read:** | **--sports shoe, it is--;** |
| **Column 4, line 54,** | **now reads:** | **"portion 41. over the"** |
| | **should read:** | **--portion 41, over the--;** |
| **Column 5, line 19,** | **now reads:** | **"openings 32. and"** |
| | **should read:** | **--openings 32, and--;** |
| **Column 5, line 22,** | **now reads:** | **"drawing. in order"** |
| | **should read:** | **--drawing, in order--;** |

UNITED STATES PATENT AND TRADEMARK OFFICE

CERTIFICATE OF CORRECTION

PATENT NO. : 6,112,433

DATED : September 5, 2000

INVENTOR(S) : Peter Greiner

It is certified that error appears in the above-identified patent and that said Letters Patent are hereby corrected as shown below:

| | | |
|---|---|---|
| Column 5, line 28, | now reads: | "that. at that" |
| | should read: | --that, at that--; |
| Column 5, line 30, | now reads: | "element. so" |
| | should read: | --element, so--; |
| Column 5, lines 43-44, | now reads: | "In addition. shocks and impacts which occur are damped. in accordance" |
| | should read: | --In addition, shocks and impacts which occur are damped. In accordance--; |
| Column 6, line 8, | now reads: | "angle a" |
| | should read: | --angle α--; |
| Column 6, line 51, | now reads: | "angle a" |
| | should read: | --angle α--; |

IN THE CLAIMS:

| | | |
|---|---|---|
| Column 9, line 12, | now reads: | "gripping clement," |
| | should read: | --gripping element--; and |

UNITED STATES PATENT AND TRADEMARK OFFICE

CERTIFICATE OF CORRECTION

PATENT NO. : 6,112,433

DATED : September 5, 2000

INVENTOR(S) : Peter Greiner

It is certified that error appears in the above-identified patent and that said Letters Patent is hereby corrected as shown below:

| | | |
|---|---|---|
| Column 9, line 23, | now reads: | "surface, insert; and" |
| | should read: | --surface; and--. |

Signed and Sealed this

Fifteenth Day of May, 2001

*Attest:*

Nicholas P. Godici

NICHOLAS P. GODICI

*Attesting Officer*

*Acting Director of the United States Patent and Trademark Office*